US006129512A

United States Patent [19]

Agram et al.

[11] Patent Number: 6,129,512

[45] Date of Patent: Oct. 10, 2000

[54] CIRCULAR STAGE OF VANES CONNECTED AT INTERNAL ENDS THEREOF BY A CONNECTING RING

[75] Inventors: Daniel André Agram; Anne-Cécile Christine Marlin, both of Vaux Le Penil, France

[73] Assignee: Societe Nationale d'Etude et de Construction de Moteurs d'Aviation "Snecma", Paris, France

[21] Appl. No.: 09/252,821

[22] Filed: Feb. 19, 1999

[30] Foreign Application Priority Data

Mar. 5, 1998 [FR] France ..... 98-02675

[51] Int. Cl.[7] ..... F01D 17/16

[52] U.S. Cl. ..... 415/160; 415/229

[58] Field of Search ..... 415/148, 150, 415/151, 159, 160, 161, 162, 229

[56] References Cited

U.S. PATENT DOCUMENTS 3,079,128 2/1963 Burge .
3,224,194 12/1965 De Feo et al. .
3,567,331 3/1971 Corrigan et al. ..... 415/160
5,636,968 6/1997 Audet et al. ..... 415/160
5,796,199 8/1998 Charbonnel ..... 415/160

FOREIGN PATENT DOCUMENTS 546935 6/1993 European Pat. Off. .
2 723 614 2/1996 France .

*Primary Examiner*—Christopher Verdier
*Attorney, Agent, or Firm*—Oblon, Spivak, McClelland, Maier & Neustadt, P.C.

[57] ABSTRACT

A rectifier vane stage is connected to a stator that is supported at the internal end thereof by a connecting ring which includes a support ring and a stiffening ring, a retaining lip of which is inserted into the support ring and similarly into the recesses of the ends of the vanes. The possibility of the vane accidentally coming loose following breakage of said vane is therefore eliminated.

3 Claims, 3 Drawing Sheets

CIRCULAR STAGE OF VANES CONNECTED AT INTERNAL ENDS THEREOF BY A CONNECTING RING

DESCRIPTION

FIELD OF THE INVENTION

The present invention relates to a circular stage of vanes whose internal ends are connected by a connecting ring.

A construction of this kind is used in turbo-machines for rectifier vane stages that are linked to the stator. The outer ends of the vanes are supported by the stator and the inner ends are supported by a connecting ring that is common to all the vanes of the stage and that therefore stiffens the assembly by connecting the vanes together. As the rectifier vanes are generally mounted to pivot in order to improve the performance of the machine at different speeds by adjusting the rectifying angle of the gas flow, the inner and outer ends of the vanes consist of pivots that are supported in respective bearings of the stator and the connecting ring.

The present patent concerns the internal section of the vanes and particularly the way in which the internal pivots are fitted inside the bearings of the connecting ring. If a vane breaks into two pieces at the middle, the outer piece remains in place because the outer pivot is usually provided with shoulders that bear on the edges of the stator bearing, whereas the internal pivot is not provided with shoulders of this kind in order to allow the connecting ring to position itself in the most suitable place by sliding on the internal pivots of the stage vanes. This causes the inner piece of the broken vane to be freed due to the pivot coming loose from the bearing. The flow of air in the machine propels the broken vane downstream which could destroy the vanes in a number of the stages that lie further on. The ocurrence of this event is even more likely given that the rectifier pivoting vanes are usually located near the entrance to the low pressure compressor such that both the high and low pressure compressors of standard turbo-machines are thus exposed to the accidents described above.

Precautions against the internal pivot coming loose in the event of a vane breaking have already been taken into account in numerous patents of the prior art. French patent 2 723 614 filed by the present applicant may be mentioned in which an additional ring (referred to as ring 33 in the patent) is added to the connecting ring to constitute a stop under the internal pivoting stages. In particular, the additional ring is punched, the ends of the internal pivots are waisted with a throat and the edges of the apertures in the additional ring are inserted into the throats of the internal pivots. A movement towards the outside of the internal pivots pulls against the additional ring and causes it to stop against the connecting ring.

SUMMARY OF THE INVENTION

Despite this apparatus being effective, it also presents the drawback that an additional ring must be provided, thus increasing the weight and the production cost of the machine. Therefore, the present invention concerns an apparatus that achieves the same results but which avoids the drawback of adding a part that only serves a single purpose. The present invention therefore enables the internal pivots to be retained using a structural part that is already present in the connecting ring and that requires only slight modification.

In its most general form, the invention may be defined as a circular stage of vanes with outer pivots that are housed in the pivoting bearings of a stator and internal pivots that are housed in a connecting ring. The connecting ring consists of a support ring and a stiffening ring that are interconnected. The support ring bears the internal pivoting bearings and the stiffening ring ends in two lips that are directed towards one another and that lie in the respective grooves in the support ring, the internal pivots being provided with a recess. In accordance with the invention, one of the lips passes through the support ring and lies in the recesses.

According to one improvement, the recesses only lie in one section of the circumference, thereby providing a stop for the angular displacements of the vane. The recesses are also useful in the event of the vane breaking.

One particular embodiment consists of a construction in which the vane pivots are in two sections in order to facilitate assembly. The lips of the stiffening ring lie in circles of two different diameters. The pivots consist of two sections: one section comprising a trunnion that is inserted into a sleeve of the bearing and the other being a widened section located between the trunnion and a vane blade. The recesses are cut into the widened sections and the lip opposite that which penetrates the recesses lies opposite the trunnions.

BRIEF DESCRIPTION OF THE DRAWING

The invention will now be described in greater detail using the following figures that are attached in order to illustrate a specific embodiment.

DESCRIPTION OF THE PREFERRED EMBODIMENTS

Figure 1:
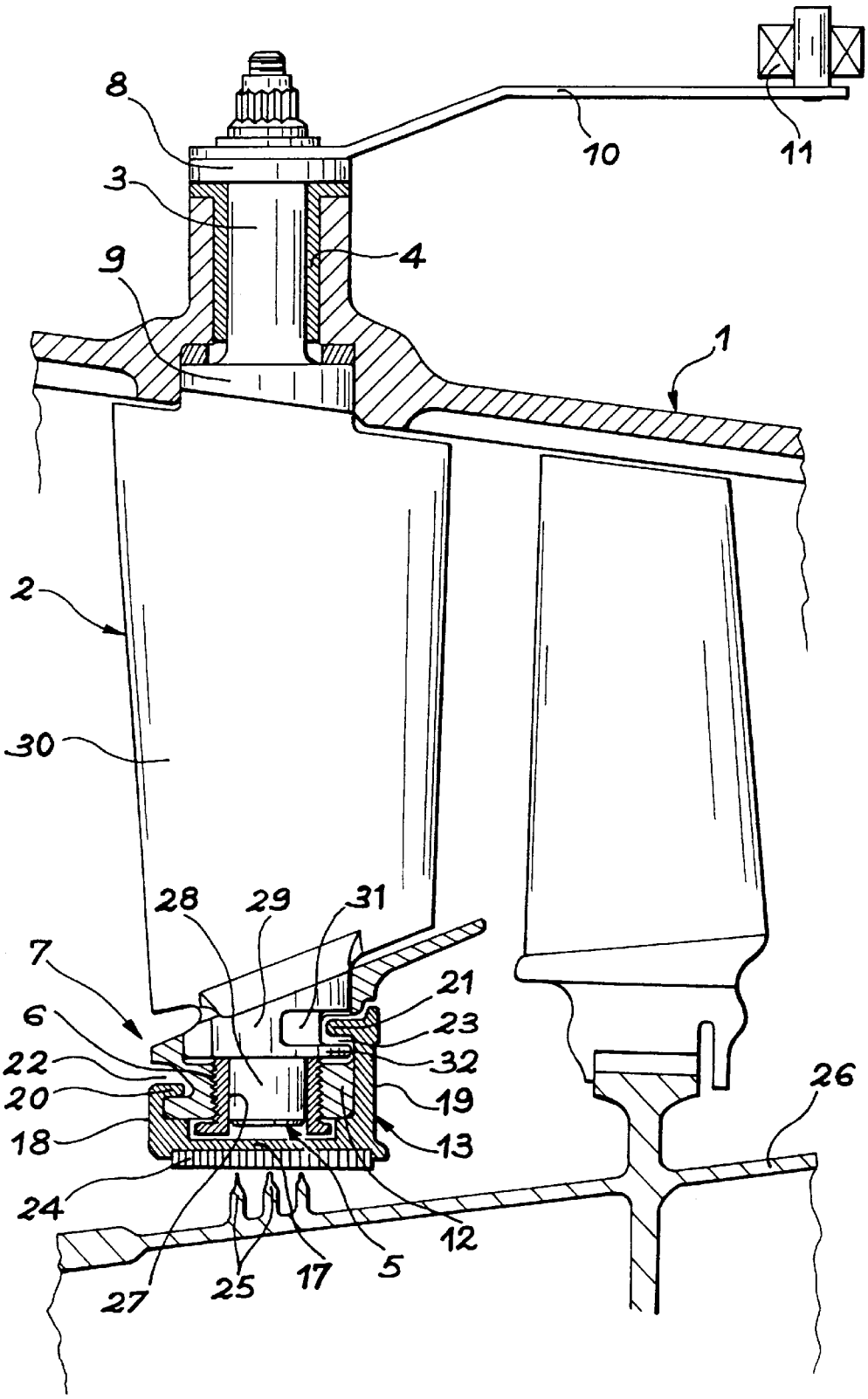
FIG. 1 is a longitudinal cross-section of a rectifier vane stage showing one of the vanes.

The machine comprises an outer stator 1 and at least one vane stage 2 that is equipped with the invention. Vanes 2 have a first end, that constitutes an outer pivot 3 that passes through stator 1 where an outer bearing 4 is located, and an opposite end that constitutes an internal pivot 5 which is inserted into a bearing 6 of a connecting ring 7, said connecting ring being connected to all vanes 2 of the stage. Outer pivot 3 is provided with shoulders 8 and 9 between which bearing 4 is retained, thereby limiting the radial displacement of vane 2 in the machine (axial displacement could also be mentioned when the direction of pivots 3 and 5 are considered). The outer pivot 3 leaves extends out of the stator 1 and ends in a connection with a control lever 10, the other end of which is connected to a control ring 11 common to all vanes 2 of the stage. Control ring 11 lies around stator 1 and it is turned in order to control the rotation of levers 10 and vanes 2 around pivots 3 and 5.

Figure 2:
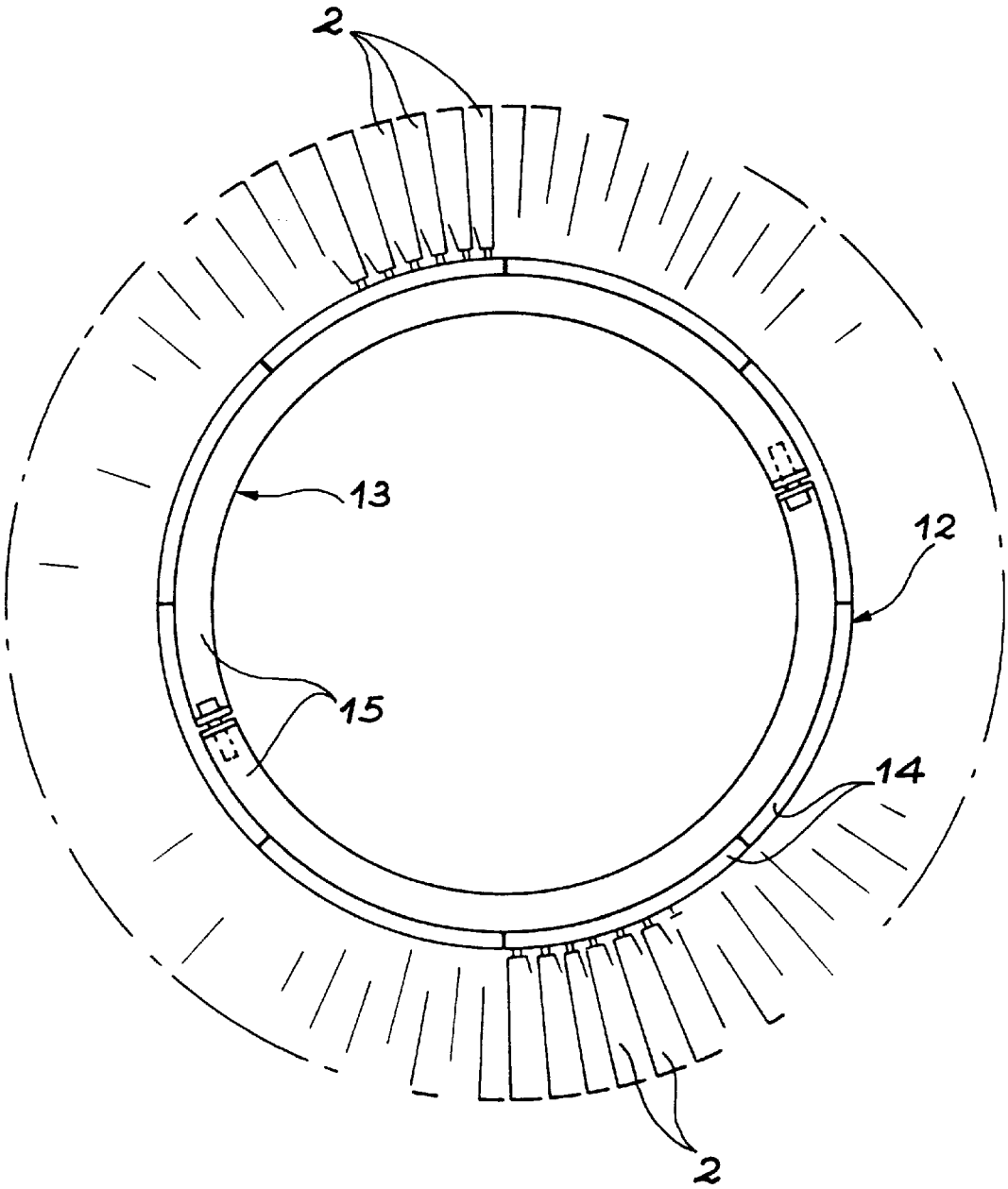
FIG. 2 is a front view of the vane stage.

Connecting ring 7 consists mainly of a support ring 12 in which bearings 6 are cut and a stiffening ring 13 that covers a section of support ring 12. The reason for this construction becomes clear on referring to FIG. 2. The figure shows that support ring 12 is not built in a single part but comprises abutting sections 14 of which there are two, four or eight sections in standard embodiments. FIG. 2 also shows stiffening ring 13 that constitutes the means for maintaining said sections in place. The stiffening ring comprises two semi-circular sections 15 that are connected together. Referring back to FIG. 1, stiffening ring 13 may be seen to have a cross-section similar to that of a rail with a bottom section 17 under support ring 12, flanks 18, 19, that partially cover the plane surfaces of support ring 12 and lips 19, and 20 that are located at the end of flanks 18, 19 that are inserted into grooves 22 and 23 of support ring 12. As lips 20 and 21 are directed towards one another they maintain stiffening ring 13 on support ring 12 and keep them interconnected. It may also be pointed out that an additional function of the stiffening ring 13 is to provide a material on the inner surface of bottom section 17 that is abradable, in other words easily worn out. Said material is used to come into contact with the circular peaks or projections 25 of a rotor 26 to create an almost leaktight seal during standard operation of the machine when the differential thermal dilations have brought projections 25 made of abradable material 24 into contact and starts to abrade it as a result of friction. It should also be mentioned that internal bearing 6 is constituted by a sleeve 27 that is inserted through a perforation in support ring 12, the outer surface of said support ring being threaded. Given that the internal pivot 5 actually consists of a trunnion 28 that is inserted into sleeve 27 and of a widened section 29 located between trunnion 28 and a blade 30 of vane 2, it may be seen that adjustment of connecting ring 7 is effected by screwing sleeve 27 into the threaded perforations of support ring 12 until the outer ends 31 of sleeve 27 abuts against widened section 29. Any deflection or vibrations in the radial direction of connecting ring 7 are therefore eliminated.

Unlike other embodiments that are already known in the art, cylindrical lips 20 and 21 do not belong to circles of the same diameter but, as one of the flanks 19 is much wider than the other flank 18, lip 21 that is borne by said flank 19 extends opposite widened section 29 whereas the other lip only lies opposite trunnion 28. Moreover, lip 21 is long enough to fit into a recess 34 cut into widened section 29, the groove 23 incorporated in the widened section passing completely through a surface of the support ring 12. The material of widened section 29 located between recess 34 and trunnion 28 constitutes an edge 32 that bears against lip 21 in the event of an outward movement of vane 2 caused, for example, by the vane breaking, and said edge resists the internal pivot 5 coming loose. This construction, that conforms to the above-mentioned objective, is extremely simple but effective in retaining the vane.

Figure 3:
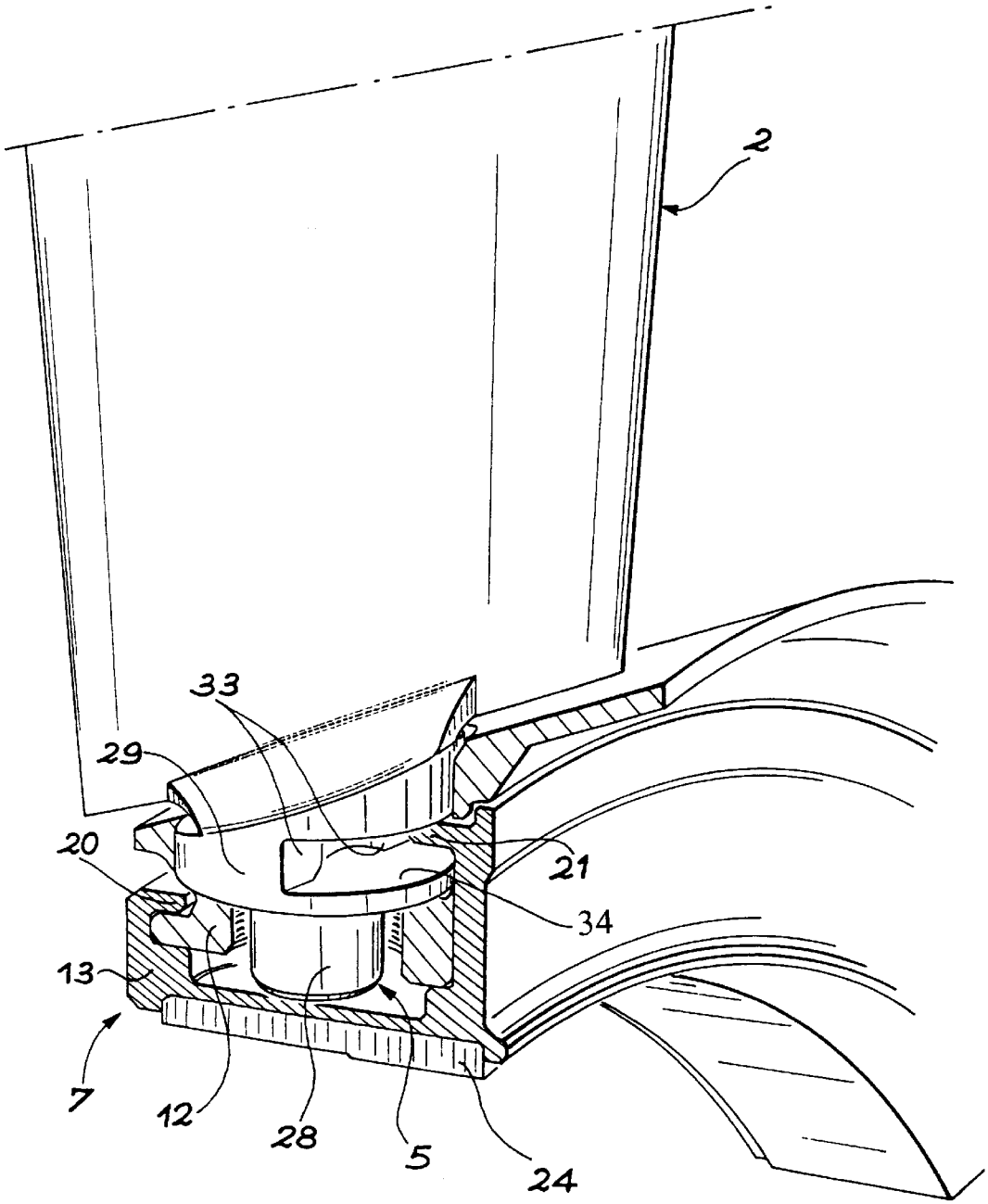
FIG. 3 shows an internal pivot of a vane inserted into the support ring.

FIG. 3 completes the description of this invention by showing the main parts of the invention even more clearly. Sleeve 27 has, however, been omitted from the drawing to show the details more clearly. It may be noted that recess 34 advantageously lies only on a section of the circumference and finishes therefore in two lateral stopping surfaces 33 that limit the angular deflection of vane 2 by coming into contact with lip 21. This is particularly advantageous in the event of vane 2 breaking and the piece of blade 30 that belongs to internal pivot 5 tailing away haphazardly, in other words freely following the direction of the gas flow.

Obviously, numerous modifications and variations of the present invention are possible in light of the above teachings. It is therefore to be understood that within the scope of the appended claims, the invention may be practiced otherwise than as specifically described herein:

1. A circular stage of blades with outer pivots that are housed in outer pivot bearings of a stator and internal pivots that are housed in internal pivot bearings of a connecting ring, which comprises;

a support ring and a stiffening ring that are interconnected and;

the internal pivot bearings mounted on said support ring, the stiffening ring having first and second lips which extend towards one another and lie in respective grooves of said support ring;

the internal pivots having recesses formed therein, wherein one of said lips extends through said support ring and lies in one of the recesses.

2. A circular stage of blades of claim 1 wherein the recesses lie only on a circumferential section of said internal pivots.

3. A circular stage of blades of claim 1 wherein said first and second lips of the stiffening ring have two different diameters at opposite ends thereof and the internal pivots comprise first and second sections, said first section comprising a trunnion that is inserted into a sleeve portion of the internal pivot bearing and the second section having a widened section, said widened section being located between the trunnion and a blade of the vane, the recesses are formed in said widened section and wherein a third lip is formed in said stiffening ring which extends opposite said trunnion.

* * * * *